US007540793B2

(12) United States Patent
Okuyama

(10) Patent No.: US 7,540,793 B2
(45) Date of Patent: Jun. 2, 2009

(54) WATERCRAFT

(75) Inventor: Takashi Okuyama, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/540,294

(22) Filed: Sep. 29, 2006

(65) Prior Publication Data

US 2007/0082565 A1 Apr. 12, 2007

(30) Foreign Application Priority Data

Oct. 7, 2005 (JP) ..... 2005-294353

(51) Int. Cl.
*B63H 21/22* (2006.01)

(52) U.S. Cl. ..... 440/1; 440/86

(58) Field of Classification Search ..... 440/1, 440/84, 86; 701/2

See application file for complete search history.

(56) References Cited

U.S. PATENT DOCUMENTS 6,587,765 B1 * 7/2003 Graham et al. ..... 701/21

7,153,174 B2 * 12/2006 Takada et al. ..... 440/1

FOREIGN PATENT DOCUMENTS

JP 08/200110 8/1996

* cited by examiner

*Primary Examiner*—Stephen Avila
(74) *Attorney, Agent, or Firm*—Knobbe, Martens, Olson & Bear, LLP

(57) ABSTRACT

A watercraft includes a remote control device disposed on a side of a hull for maneuvering the watercraft, and a plurality of outboard motors disposed on a side of a stern of the hull for generating thrust under control of the remote control device. A remote control body of the remote control device encloses a plurality of first remote control side ECUs for controlling the respective outboard motors. The respective first remote control side ECUs are connected to each other through an ECU communication line enclosed in the remote control body and the respective first remote control side ECUs communicate operational information.

21 Claims, 7 Drawing Sheets

WATERCRAFT

CROSS-REFERENCE TO RELATED APPLICATIONS

This application claims priority to Japanese Patent Application Number 2005-294353, which was filed on Oct. 7, 2005, the entirety of which is hereby incorporated by reference.

BACKGROUND OF THE INVENTION

1. Field of the Invention

This invention relates to a watercraft having a hull supporting a plurality of watercraft propulsion devices for generating thrust, and more particularly relates to a watercraft in which information can be mutually transmitted between controllers of the respective watercraft propulsion devices.

2. Description of the Related Art

With reference to FIG. 7, a watercraft may include two outboard motors 2, 2 disposed at a stern of a hull I of the watercraft. Throttle valves 3, 3 of the respective outboard motors 2, 2 are connected to a remote control lever 5 through transmission mechanisms 4, 4 such as, for example, mechanical cables, links or the like. Each outboard motor 2, 2 has an engine side ECU 6 that controls an ignition timing, a fuel injection timing, a fuel injection amount and so forth in accordance with throttle valve opening (load) detection amounts sent from throttle valve opening sensors mounted to the throttle valves 3, 3 and engine speed detection amounts sent from respective crankshaft angle sensors (not shown).

In the outboard motors 2, 2, when an operator pivots the remote control lever 5 to vary the throttle valve openings, the respective engine side ECUs 6, 6 control the fuel injection amounts, the ignition timings, etc. in accordance with the openings of the respective throttle valves 3, 3 to adjust the engine speeds.

Meanwhile, the mechanical transmission mechanisms 4, 4 connecting the remote control lever 5 and the throttle valves 3, 3 of the respective outboard motors 2, 2 to each other may have production errors, adjustment errors, design changes and the like. Therefore, even though operational amounts of the remote control lever 21 are equal, the openings of the throttle valves 3, 3 can differ from each other. Consequently, the engine speeds of the respective outboard motors 2, 2 can be different from each other. As such, the thrusts of the respective outboard motors 2, 2 can be different from each other, thus urging the hull I to move in a direction that is not intended by the operator even though the motors are both steered in straight-ahead positions.

In Japanese Patent Document No. JP-A-Hei 8-200110, the respective engine side ECUs 6, 6 are connected to each other through a communication line 8 using connectors 7. Various detection amounts (i.e., operational information) such as, for example, the throttle valve openings and the engine speeds are mutually transmitted between the respective ECUs 6, 6 through the communication line 8. In addition, detection amounts of an atmospheric air temperature sensor and an atmospheric pressure sensor which are attached to one of the outboard motors 2, 2 can be sent to the other outboard motor 2.

As noted above, the engine side ECUs 6, 6 send and receive the engine speed signals of the respective outboard motors 2, 2 through the communication line 8. If a difference between the engine speeds of the respective engines is larger than a preset amount under a normal running condition, the engine side ECUs 6, 6 control the engine speeds of the respective outboard motors 2, 2 to keep the difference within an objective range.

SUMMARY OF THE INVENTION

Applicant has noted that the communication line 8 between the respective outboard motors 2, 2 is in an exposed disposition because the engine side ECUs 6, 6 of the respective outboard motors are connected to each other through the communication line 8. The communication line 8 thus can be easily damaged, and the connectors 7 can be unintentionally disconnected from one another due to their exposed position.

Accordingly, there is a need for watercraft in which a communication line for mutually transmitting signals between a plurality of watercraft propulsion devices is not in an exposed position between the propulsion devices.

In accordance with one embodiment, a watercraft is provided comprising a hull supporting a first propulsion device and a second propulsion device. The propulsion devices are adapted to generate thrust for propelling the watercraft. A control device has a first electronic control unit (ECU) and a second ECU. The first ECU is adapted to send signals to control the first propulsion device and to receive operation information signals from the first propulsion device. The second ECU is adapted to send signals to control the second propulsion device and to receive operation information signals from the second propulsion device. A communication line electronically links the first and second ECUs so that operation information is transmitted between the first and second ECUs.

In another embodiment, the control device comprises a housing, and the first ECU, second ECU, and communication line are enclosed within the housing.

In one embodiment, operation information transmitted between the ECUs comprises detected engine speed. In another embodiment, the first and second ECUs adjust controlled operation of the first and second propulsion devices, respectively, so that a difference in engine speed between engines of the first and second propulsion devices is within a preset range.

Another embodiment additionally comprises a command device for sending a command signal to the propulsion devices. The command device is electronically connected to one of the first and second ECUs, and the command signal is transmitted to the other of the first and second ECUs through the communication line. In one embodiment, the command device comprises a switch to signal startup of the propulsion devices.

Yet another embodiment additionally comprises a user interface disposed at a cockpit of the watercraft. The user interface comprises a display and at least one operational switch. The user interface is electronically connected to one of the first and second ECUs, and signals from the user interface are transmitted to the other of the first and second ECUs through the communication line.

Still another embodiment additionally comprises a third propulsion device supported by the hull and a third ECU adapted to send signals to control the third propulsion device and to receive operation information signals from the third propulsion device. The communication line electronically links the first, second and third ECUs so that operation information is transmitted between the first, second and third ECUs.

In a further embodiment, the control device comprises a housing, and the first ECU, second ECU, and at least part of the communication line are enclosed within the housing. A second control device is also provided, and has a housing generally enclosing the third ECU.

In yet another embodiment, the control device comprises a first shift/throttle lever adapted to generate a signal to control the first propulsion device and a second shift/throttle lever adapted to generate a signal to control the second propulsion device. The third propulsion device is arranged on the hull between the first and second propulsion devices. The third ECU receives a signal from each of the first and second shift/throttle levers. The third ECU generates a signal to control the third propulsion device at a throttle setting between the throttle settings of the first and second shift/throttle devices.

Still another embodiment additionally comprises a fourth propulsion device supported by the hull and a fourth ECU adapted to send signals to control the fourth propulsion device and to receive operation information signals from the fourth propulsion device. The communication line electronically links the first, second, third and fourth ECUs so that operation information is transmitted between the first, second, third and fourth ECUs. The second control device generally encloses the fourth ECU.

A still further embodiment additionally comprises means for controlling operation of the first and second propulsion devices, respectively, so that a difference in engine speed between engines of the first and second propulsion devices is within a preset range.

DETAILED DESCRIPTION OF PREFERRED EMBODIMENTS

With initial reference to FIGS. 1 through 4, an embodiment of a watercraft has two outboard motors 11, also referred to as "watercraft propulsion devices", disposed at a stern of a hull 10. A remote control device 12 is disposed in a center area of a cockpit of the hull 10 to control the outboard motors 11 for moving the watercraft.

Figure 1:
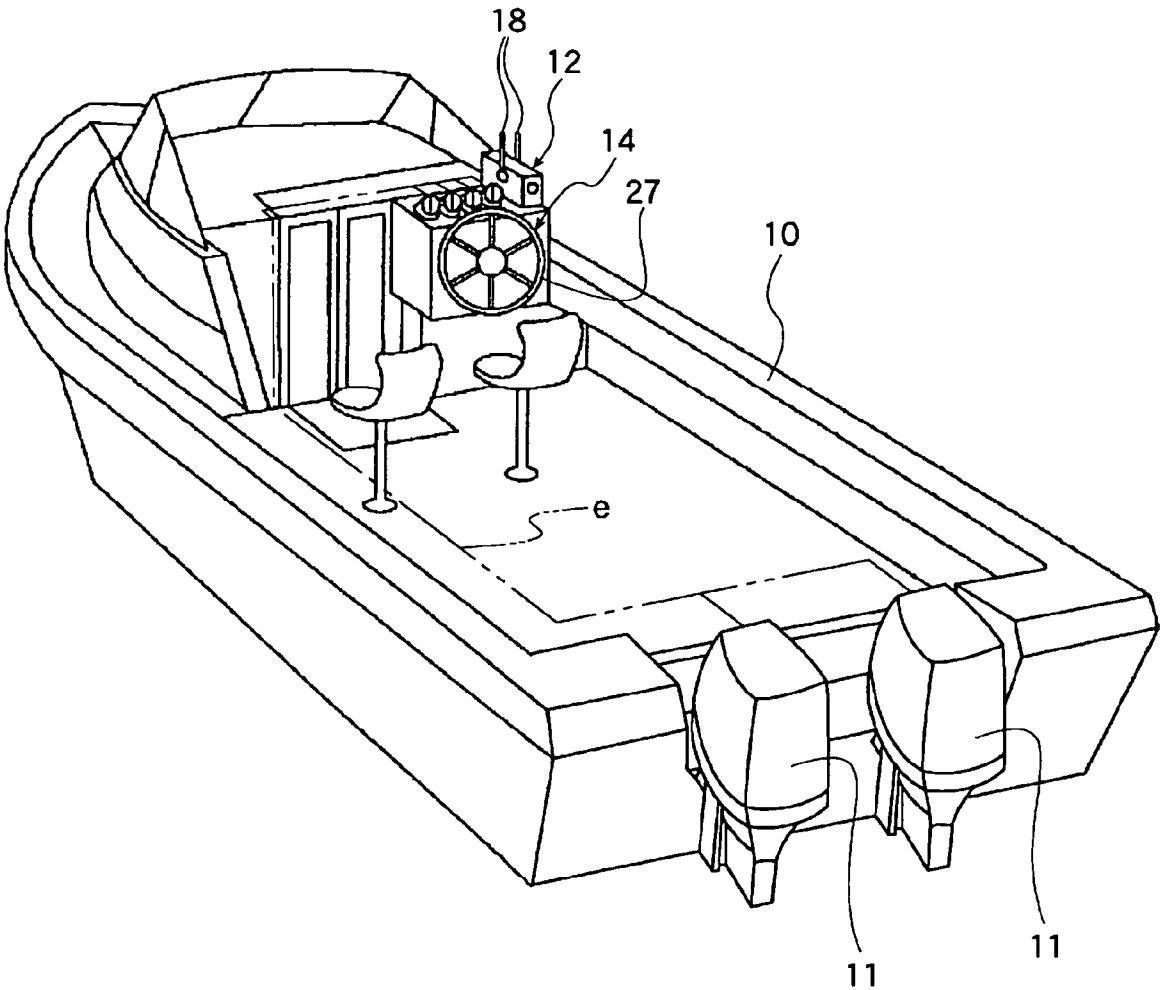
FIG. 1 is a perspective view of a watercraft according to an embodiment of this invention.
Figure 2:
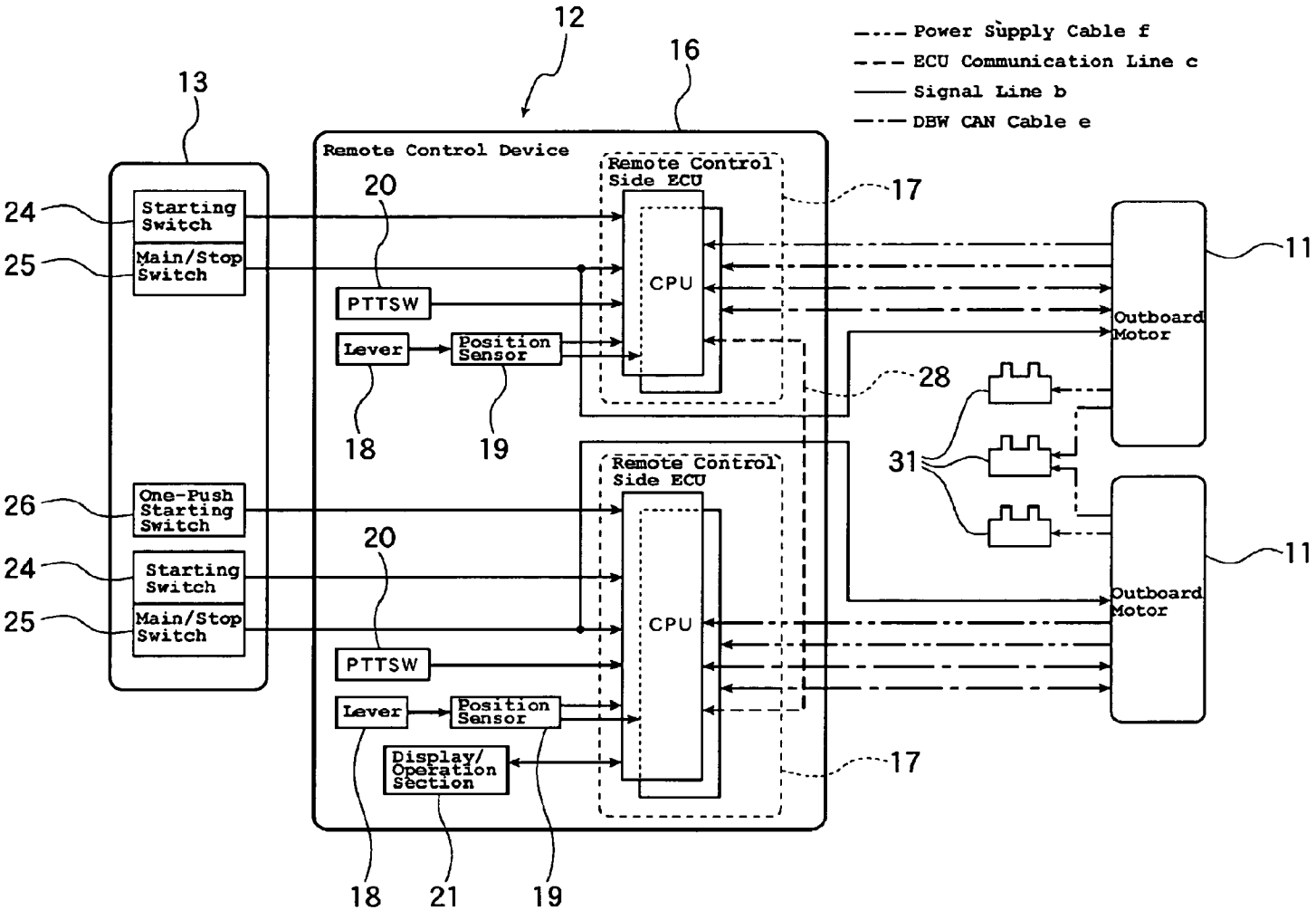
FIG. 2 is a block diagram showing connecting conditions of a remote control device, a key switch device and outboard motors in accordance with the watercraft of FIG. 1.

As shown specifically in FIGS. 1 and 2, a key switch device 13 and a steering handle device 14 preferably are disposed in the cockpit, other than the remote control device 12.

With specific reference to FIG. 2, the remote control device 12 preferably has a remote control body 16 in which first remote control side ECUs 17, each corresponding to a respective one of the outboard motors 11 are disposed. Two remote control levers 18 correspond to respective first remote control side ECUs 17 to make a throttle valve control operation and a shift operation of the respective watercraft propulsion devices. The remote control device 12 also has position sensors 19 for detecting positions of the remote control levers 18. Each position sensor 19 is connected to the respective first remote control side ECU 17 through two signal lines b. A PTT (power trim and tilt) switch 20 preferably is connected to a respective first remote control side ECUs 17 through a signal line b. Also, a display/operation section 21 for changing a steering system mode is connected to one of the first remote control side ECUs 17 through a signal line b.

The key switch device 13 preferably is connected to the respective first remote control side ECUs 17 of the remote control device 12. The key switch device 13 includes starting switches 24 and main/stop switches 25 both corresponding to the respective first remote control side ECUs 17. A one-push starting switch 29 corresponding to one of the first remote control side ECUs 17. The starting switches 24, the main/stop switches 25 and the one-push starting switch 29 are connected to the first remote control side ECUs 17 through signal lines b.

The steering handle device 14 preferably has a built-in steering handle device side ECU (is not shown) and a steering wheel 27 for steering the outboard motors 11. A position sensor detects the steering wheel position and preferably is connected to the steering handle device side ECU through a signal line.

The steering handle device side ECU of the steering handle device 14 preferably is connected to the first remote control side ECUs of the remote control device 12 through DBW CAN cables functioning as signal lines. In this regard, the term "DBW" is short for the drive-by-wire and relates to a control device which has electrical connections replacing traditionally mechanical connections. The term "CAN" is short for the controller area network.

In the illustrated embodiment, the first remote control side ECUs 17 are connected to each other through an ECU communication line 28 provided in the remote control body 16 so that information can be transmitted between the respective first remote control side ECUs 17 through the ECU communication line 28. The information includes various pieces of information such as, for example, an engine speed and a throttle valve opening of each motor 11.

Figure 4:
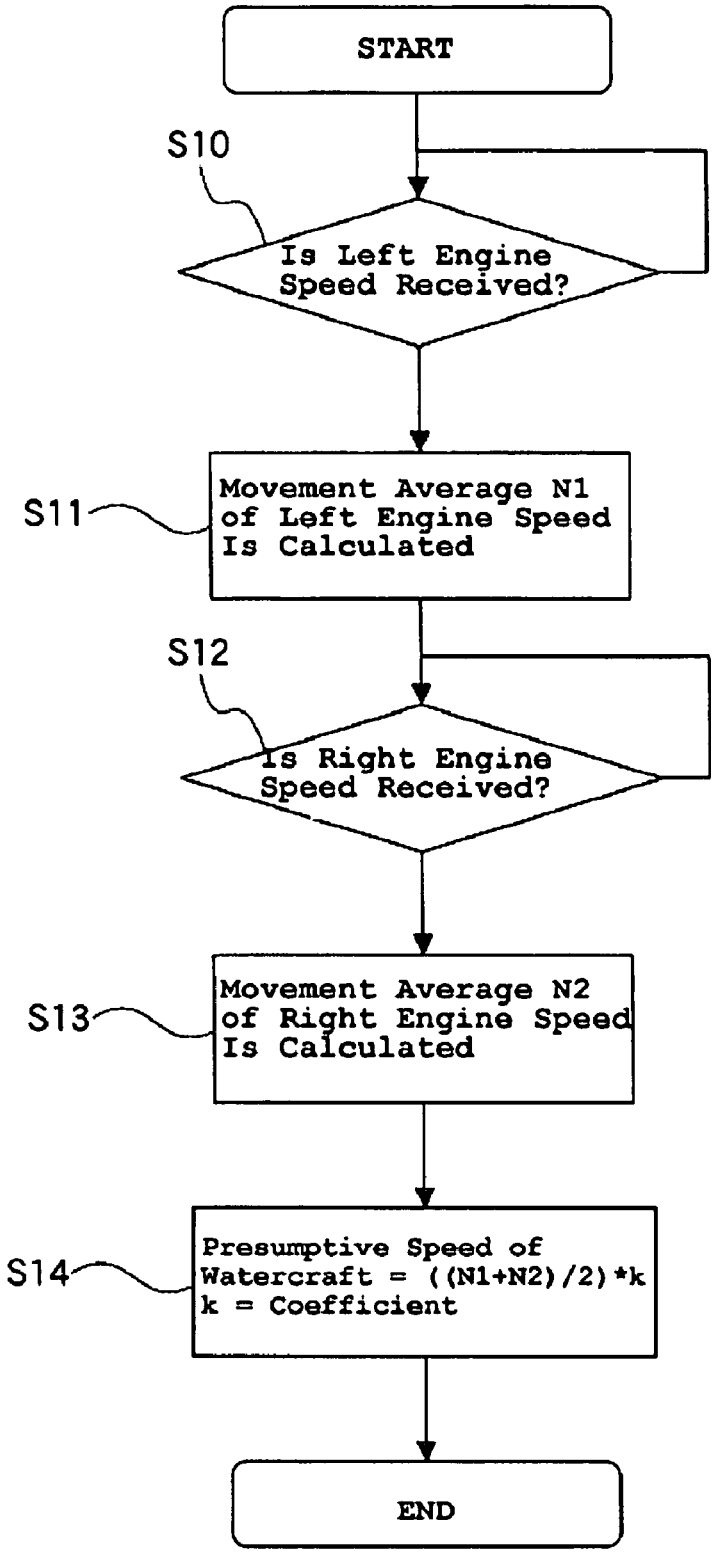
FIG. 4 is a flowchart used to determine a presumptive speed of the watercraft of FIG. 1.

With continued reference to FIG. 4, the respective first remote control side ECUs 17 are connected to engine side ECUs (separately not shown) disposed in the respective outboard motors 11. The connection preferably includes power supply cables f and DBWCAN cables e. In the illustrated embodiment, three batteries 31 are connected to the first remote control side ECUs 17 through power supply cables f.

Each engine side ECU preferably is configured to properly control various engine operational conditions such as, for example, a fuel injection amount, a fuel injection timing and an ignition timing based upon a throttle valve opening signal sent from a throttle valve opening sensor, an engine speed signal sent from a crankshaft angle sensor and other detection signals sent from various other sensors.

Each engine side ECU also sends the throttle valve opening, the engine speed and other detection amounts (referred to as "operational information") to the associated first remote control side ECU 17 through DBWCAN cables e. The operational information is mutually transmitted between the respective first remote control side ECUs 17 through the ECU communication line 28.

Thus, each ECU 17 obtains operational information about both outboard motors. The control signals sent from the respective first remote control side ECUs 17 control the engine side ECUs of the respective outboard motors 11. In accordance with one embodiment, one or more of the fuel injection amount, the fuel injection timing, the ignition timing and the like are controlled so that a difference between the engine speeds of the respective outboard motors 11 falls within an objective range.

When the operator desires to move the watercraft, the operator operates the starting switches 24 to activate the outboard motors 11. A signal from each starting switch 24 is inputted to the respective first remote control side ECU 17 and is further inputted to the engine side ECU of the associated outboard motor 11 from the first remote control side ECU 17 through the DBW CAN cable e. Thus, the starting system, the ignition system, the fuel injection system and the like are controlled, and the throttle valve is opened by each throttling motor to start the respective engine.

When each remote control lever 18 is operated under the condition that the respective outboard motor 11 is in operation, the signal from the position sensor 19 is inputted to the associated first remote control side ECU 17, and a position signal of the remote control lever 18 is sent to each engine side ECU from each first remote control side ECU 17. As directed by the engine side ECU, the throttle valve is driven by the throttling motor based on the position of the remote control lever 18 so that the associated engine generates power. The propeller thus generates desired thrust to provide a desired speed of the watercraft.

During operation, the throttle valve opening, engine speed, etc. as detected by the respective sensors are inputted to each engine side ECU, and the detection signals are passed along to the respective first remote control side ECU 17. The respective detection signals are then mutually transmitted between the respective first remote control side ECUs 17 through the ECU communication cable 28.

If the engine speeds of the respective outboard motors 11 differ significantly from each other, the respective first remote control side ECUs 17 preferably communicate with each other based upon the various detection signals (operational information) including the throttle valve opening and engine speed signals to adjust control of the respective outboard motors 11 so that the difference between the respective engine speeds can fall within a desired range of difference.

The control signals from the respective first remote control side ECUs 17 control the engine side ECUs of the respective outboard motors 11. Specifically, the fuel injection amount, the fuel injection timing, the ignition timing, etc. are controlled so that the engine speeds of the respective outboard motors 11 generally harmonize with each other.

In accordance with one embodiment, under a normal running condition, when the difference between the engine speeds of the respective outboard motors 11 is greater than a preset amount, the operation of at least one cylinder of the outboard motor 11 having the higher engine speed is deactivated, thus reducing the power output and engine speed. Thereby, the difference between the engine speeds of the respective outboard motors 11 can be maintained within the objective range. In the cylinder deactivation control, the number of cylinders that are deactivated and frequencies of the deactivation can be properly controlled.

Figure 3:
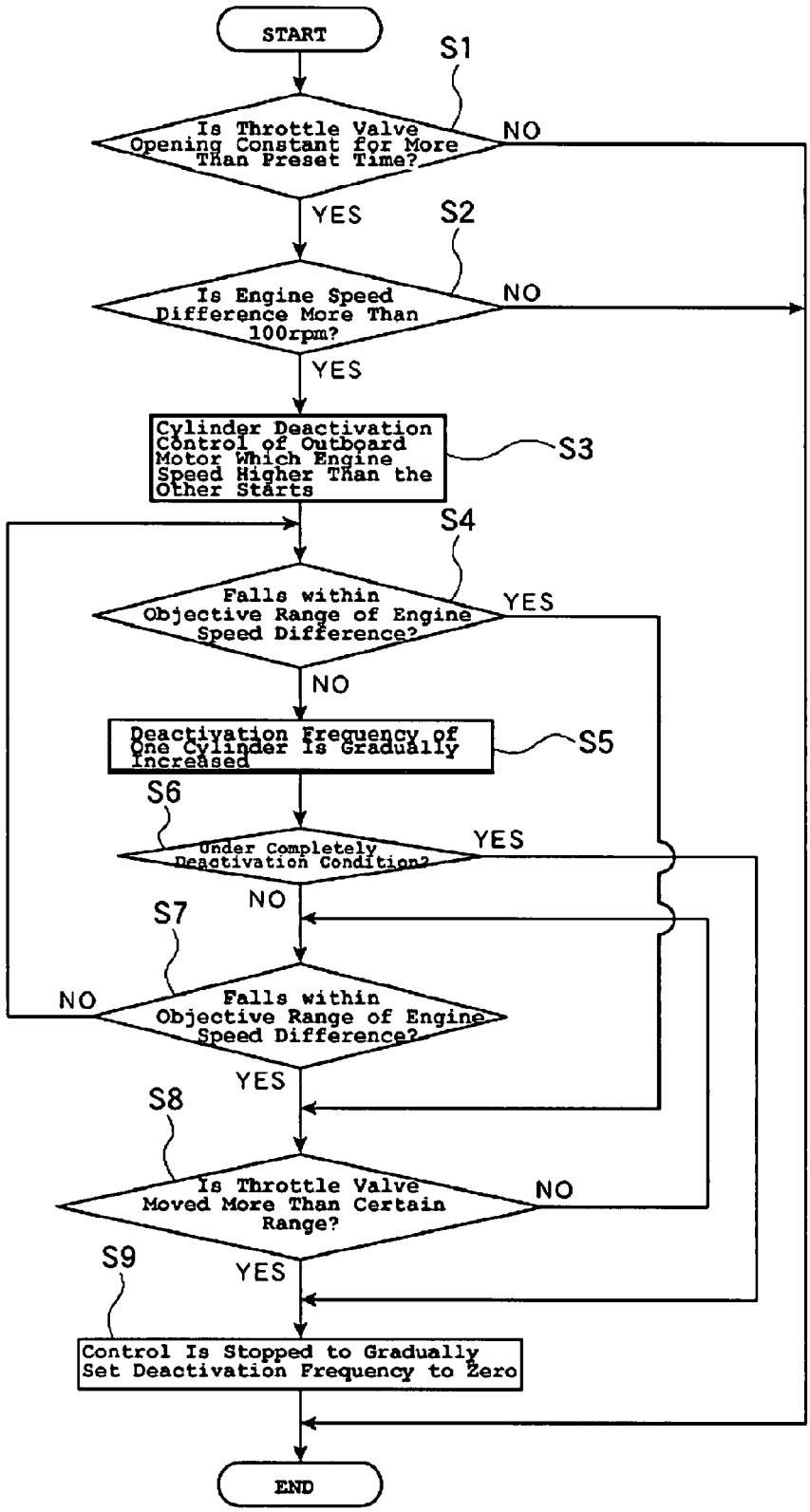
FIG. 3 is a flowchart showing one embodiment of a routine for generally equalizing engine speeds of two outboard motors on the watercraft of FIG. 1.

With reference next to FIG. 3, an embodiment of a control routine is shown. Preferably the routine is performed by one or both of the first ECUs 17. In accordance with the routine, it is first determined whether the throttle valve opening is constant for more than a preset period of time, i.e., whether a normal running condition is maintained or not is yet achieved (step S1). If the normal running condition is determined, step S2 determines whether the difference between the engine speeds of the respective outboard motors 11 is greater than a preset amount N (for example, 100 rpm).

If the engine speed difference is determined to be greater than the preset amount N, a cylinder deactivation control is initiated on one cylinder of the engine of the outboard motor 11 which has an engine speed higher than the other (step S3). As long as the engine speed difference exceeds the objective range N, the frequency of the deactivation control of the cylinder is increased until the cylinder is under the completely deactivated condition (Steps S4-S7). In one embodiment, deactivation of a second cylinder may commence if necessary to continue lowering engine speed. In another embodiment, if engine speed harmonization is not achieved upon complete deactivation of a cylinder, an error code is generated to indicate that the lower-speed engine needs service.

When the difference between engine speeds of the respective outboard motors 11 falls within the preset objective range N, the cylinder deactivation condition is maintained until the throttle valve opening varies more than a preset opening amount, indicating a significant throttling change. If the throttle valve opening changes, the frequency of the deactivation control of the cylinder to be deactivated is gradually reduced (Step S8). After the deactivation frequency is set to zero (Step S9), the program ends.

Additionally, if the throttle valve opening is not constant for the preset period of time at the step S1, or the engine speed difference is not greater than the preset amount N at the step S2, the cylinder deactivation control is not conducted and the program ends.

On the other hand, when each control lever 18 is set at one of the forward position, the neutral position and the reverse position, the position is detected, and the engine side ECU corresponding to the control lever 18 controls a shift motor based upon this detection signal to drive a shift mechanism of each outboard motor 11. The thrust direction and so forth are provided accordingly.

In the steering control, when the operator pivots the steering wheel 28 in a certain direction, the position sensor detects the steering angle. A signal indicative of the steering angle is inputted to each steering operating side ECU through the steering handle device side ECU. The steering operating side ECU controls a steering motor to drive the associated outboard motor II through a steering mechanism. The respective outboard motors 11 thus are steered to the direction corresponding to the given steering angle.

As discussed above, the first remote control side ECU 17 is allotted to each outboard motor 11, and the first remote control side ECU 17 is electrically connected to the engine side ECU to control the respective outboard motor 11. Because this control system does not need any conventional mechanical transmission mechanism 4 or the like, no production errors, adjustment errors nor secular changes occur. The difference between the engine speeds of the respective outboard motors 11 is thus minimized even before being evaluated for correction.

Because the remote control body 16 encloses the ECU communication line 28 connecting the respective first remote control side ECUs 17, the ECU communication line 28 is not exposed to the environment. The ECU communication line 28 thus is not damaged due to exposure and is not open to being unintentionally disconnected. The reliability of the system is thus improved.

Preferably, because the user does not make the physical connection of the ECU communication line 28, user error is avoided, thus further enhancing reliability.

Because the ECU communication line 28 preferably is formed with an operation type communication system (CAN or the like), the respective first remote control side ECUs 17 can be electrically insulated from each other, thus even further enhancing reliability.

The one-push starting switch 26 preferably is connected to one of the first remote control side ECUs 17 as the "command device." Upon the operation of the one-push starting switch 26, not only the first remote control side ECU 17 connected to the one-push starting switch 26 sends the operation signal (command signal) to the associated engine side ECU 17 but also the other first remote control side ECU 17 sends the operation signal to the associated engine side ECU because the operation signal is transmitted from the former ECU 17 to the latter ECU 17 through the ECU communication line 28. Thereby, both of the outboard motors 11 can be simultaneously started through actuating a single switch 26.

It is understood, however, that the respective outboard motors 11 can be individually started/stopped using the respective starting switches 24, the main/stop switches 25 or the like.

With reference again to FIG. 2, the display/operation section 21 preferably is directly connected to one of the first remote control side ECUs 17 and is indirectly connected to the other first remote control side ECU 17 through the ECU communication line 28. Thus, the display/operation of the respective first remote control side ECUs 17 can be conducted using a single display/operation section 21. The display section thereof preferably has functions of free throttling, watercraft maneuvering station and malfunction diagnosis, while the operation section thereof preferably has functions of free throttle change, cockpit seat change or the like.

Three batteries 31 preferably are provided. One of the batteries is connected to both of the outboard motors 11. As such, two of the batteries 31 are each dedicated to a corresponding one of the outboard motors 11. Thus, even if one battery 31 becomes exhausted, another battery 31 can continuously supply power.

In accordance with an embodiment as shown in the flowchart of FIG. 4, a presumptive speed of the watercraft preferably can be calculated as discussed below. First, left engine speed data of the outboard motor 11 on the left side is received (step S10). When the data is received, a movement average of the left engine speed is calculated (step S11). A movement average determines a travel distance corresponding to an engine speed over a fixed period of time.

Next, right engine speed data of the outboard motor 11 on the right side is received (step S12). When the data is received, a movement average of the right engine speed is calculated (step S13).

Afterwards, an average of the respective movement averages of the right and left engine speeds is multiplied by a coefficient k for calculating the presumptive speed of the watercraft (step S14).

Accordingly, even though engine speeds of the right and left outboard motors 11 may differ slightly from each other, a rough watercraft speed can be calculated. In accordance with the presumptive speed of the watercraft, for example, a load of the steering handle device can be varied. When the watercraft speed is high, the load of the steering handle device can be larger so that the operator feels some difficulty in operating the steering wheel. When the watercraft speed is low, the load of the steering handle device can be smaller so that the operator can easily operate the steering wheel.

As such, even though the engine speeds of the multiple outboard motors 11 may be different from each other, a steering handle load control that generally matches conditions can be determined.

The illustrated embodiment employs cylinder deactivation to reduce the engine speed of a higher-engine-speed motor to achieve engine speed harmonization. In another embodiment, control adjustments to increase the engine speed of a lower-engine-speed motor may be taken to achieve engine speed harmonization. For example, the throttle opening of the lower-engine-speed motor may be successively increased until harmonization is achieved. In still other embodiments, combinations of adjustments to increase and/or decrease engine speed may be made in an effort to achieve engine speed harmonization.

Figure 5:
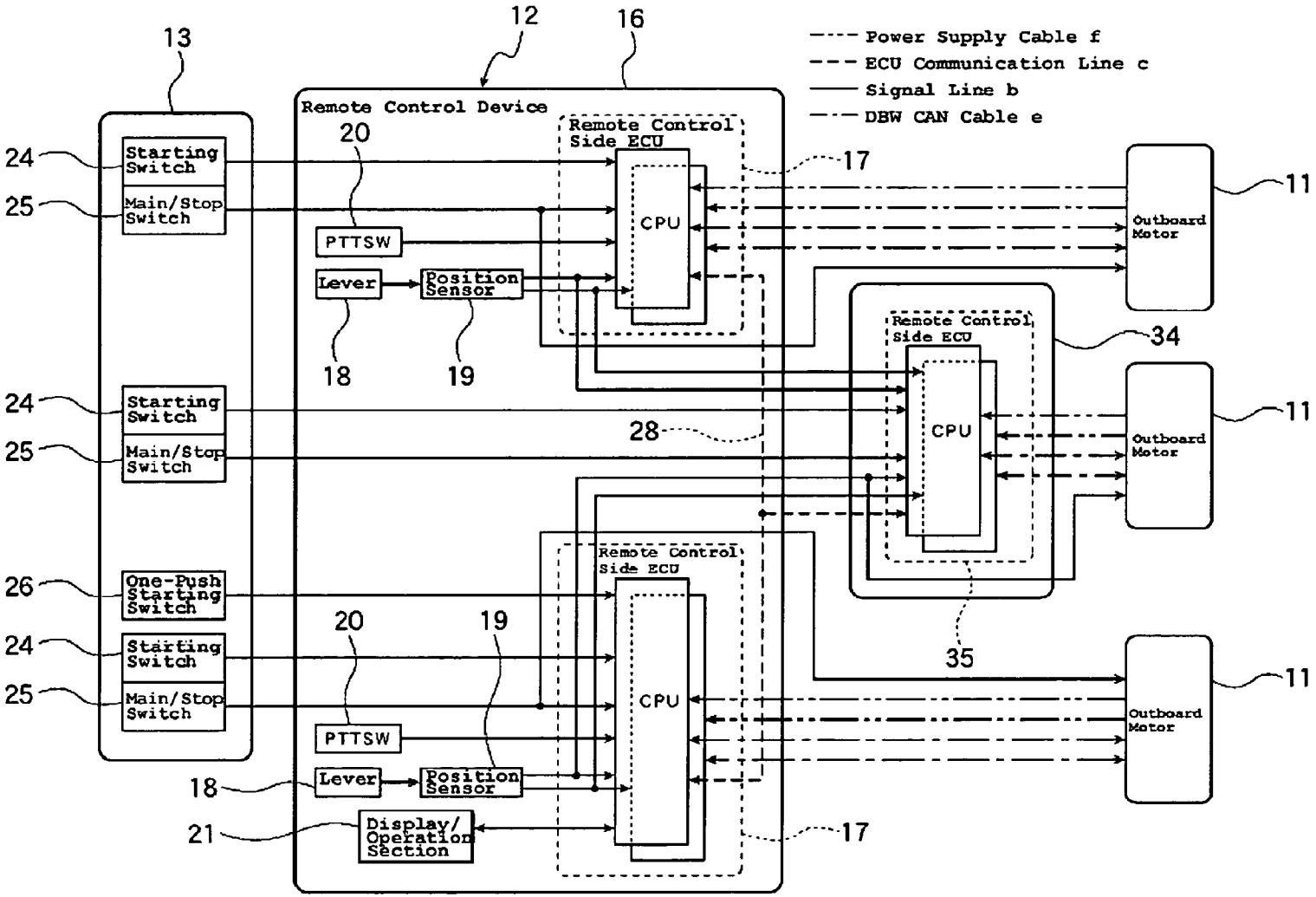
FIG. 5 is a block diagram of a watercraft remote control arrangement according to another embodiment.

With reference next to FIG. 5, an embodiment of a remote control system for a watercraft having three outboard motors 11 is illustrated. In this embodiment the remote control device 12 has an expansion unit 34 disposed outside of the remote control body 16. The expansion unit 34 has a second remote control side ECU 35 corresponding to an additional outboard motor 11 positioned between the two outboard motors 11 already described above.

The second remote control side ECU 35 and the respective first remote control side ECUs 17 are connected to each other through the ECU communication line 28.

The second remote control side ECU 35 is connected to an engine side ECU of the outboard motor 11 located at the center through power supply cables f and DBW CAN cables e.

A starting switch 24 and a main/stop switch 25 preferably are additionally disposed in the key switch device 13, and are connected to the second remote control side ECU 35. The right and left position sensors 19 preferably are also connected to the second remote control side ECU 35.

In this embodiment, shift and throttle objectives for the outboard motor 11 positioned at the center are determined by the signals from the pair of the right and left position sensors and the second remote control side ECU 35. For example, if different shift information and throttle valve information is inputted to the second remote control side ECU 35 from the respective position sensors 19, the second remote control side ECU 35 controls the outboard motor 11 to be placed at a middle position. In one embodiment, the second remote control side ECU 35 places the outboard motor 11 at a position halfway between the positions of the right and left position sensors 19. Thus, the shift and throttle control of the engine of the center outboard motor 11 can be optionally made through the position sensors 19 of the right and left remote control levers 18.

In a preferred embodiment, the second remote control side ECU 35 of the center outboard motor 11 is separately provided from the remote control body 16 (as a three outboard motor mounting system unit) and the expansion unit 34 is disposed outside of the remote control body 16. Thereby, the number of outboard motors 11 can be easily increased or decreased without changing the remote control body 16 by simply exchanging the expansion unit 34 for another one.

Figure 6:
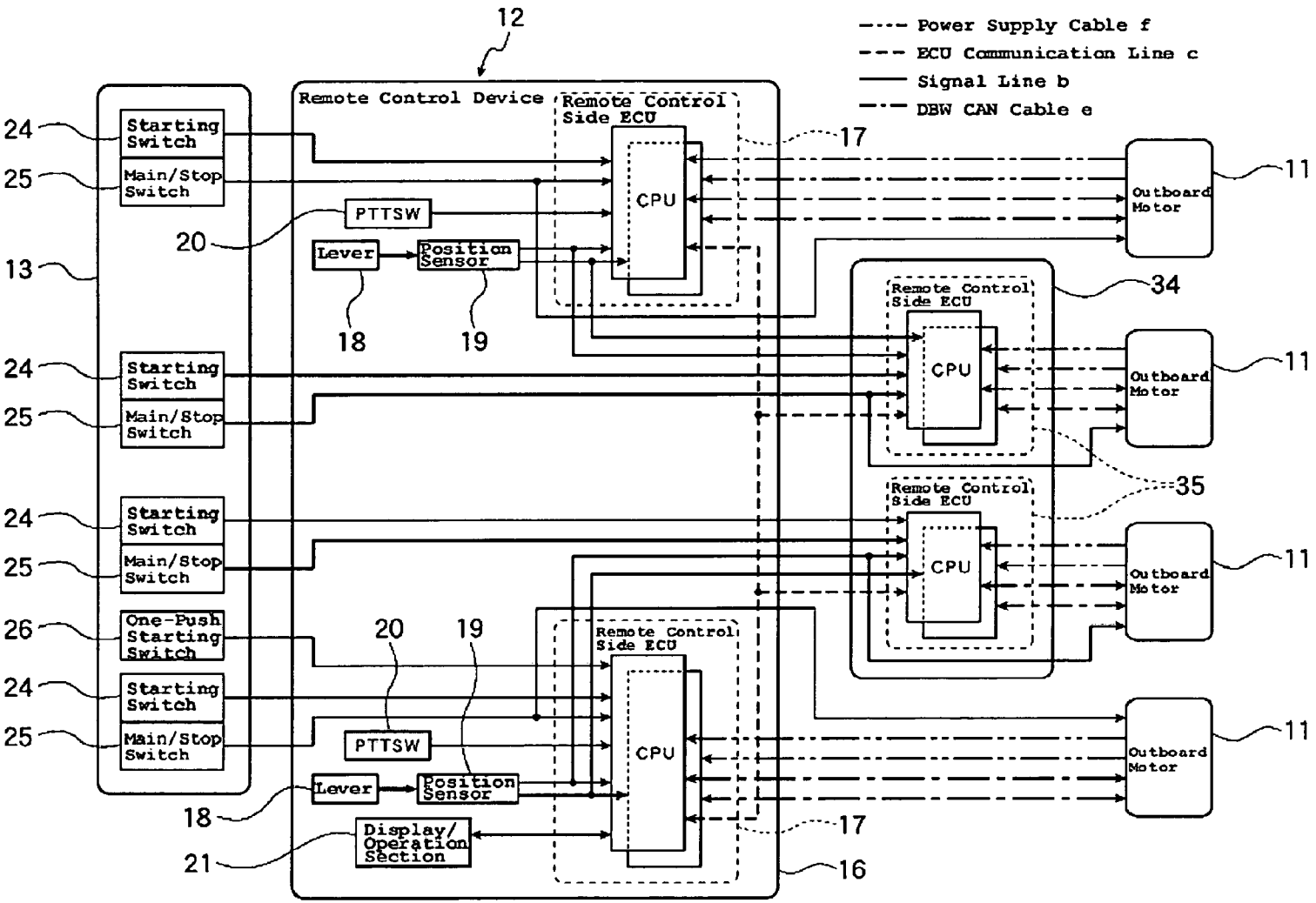
FIG. 6 is a block diagram of a watercraft remote control arrangement according to yet another embodiment.
Figure 7:
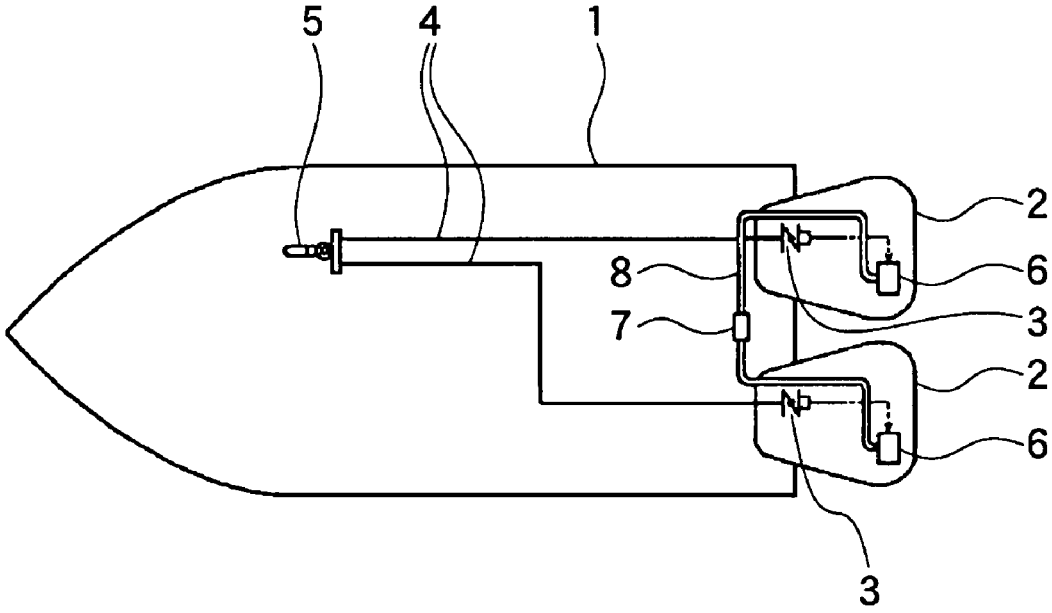
FIG. 7 is a schematic top plan view of a conventional watercraft.

With reference next to FIG. 6, an embodiment of a remote control system for a watercraft having four outboard motors 11 is illustrated. The remote control device 12 has an expansion unit 34 disposed outside of the remote control body 16. The expansion unit 34 has two second remote control side ECUs 35 corresponding to additional outboard motors 11 positioned between the two outboard motors 11 described above.

The two second remote control side ECUs 35 and the two first remote control side ECUs 17 are connected to each other through the ECU communication line 28.

The two second remote control side ECUs 35 are connected to engine side ECUs of the two outboard motors 11 located at the center through power supply cables f and DBW CAN cables e.

Starting switches 24 and main/stop switches 25 preferably are additionally disposed in the key switch device 13 and are connected to the two second remote control side ECUs 35.

One of the right and left pair of the position sensors 19 is connected to one of the two second remote control side ECUs 35, while the other one of the right and left pair of the position sensors 19 is connected to the other one of the second remote control side ECUs 35.

Since the expansion unit 34 is disposed outside of the remote control body 16, the number of outboard motors 11 can be easily changed without changing the remote control body 16 and by simply exchanging the expansion unit 34 for another one.

Although the outboard motors 11 are used as the "watercraft propulsion device" in the embodiments described above, the "watercraft propulsion device" is not limited to such an outboard motor. For example, the propulsion device may include inboard/outboard drives.

Although this disclosure has presented certain preferred embodiments and examples, it will be understood by those skilled in the art that the present inventions extend beyond the specifically disclosed embodiments to other alternative embodiments and/or uses and obvious modifications and equivalents thereof. In addition, while a number of variations have been shown and described in detail, other modifications, which are within the scope of invention, will be readily apparent to those of skill in the art based upon this disclosure. It is also contemplated that various combinations or subcombinations of the specific features and aspects of the embodiments may be made and still fall within the inventive scope. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

What is claimed is:

1. A watercraft comprising a hull supporting a first propulsion device and a second propulsion device, the propulsion devices adapted to generate thrust for propelling the watercraft, a control device adapted to receive control inputs from a user and having a housing that encloses a first electronic control unit (ECU) and a second ECU, the first ECU adapted to send signals to control the first propulsion device and to receive operation information signals including at least an engine speed from the first propulsion device, the second ECU adapted to send signals to control the second propulsion device and to receive operation information signals including at least an engine speed from the second propulsion device, wherein a communication line electronically links the first and second ECUs so that operation information is transmitted between the first and second ECUs, and wherein the first ECU, second ECU and communication line are enclosed within the control device housing, wherein the control device is configured to determine a first moving average of an engine speed of the first propulsion device, a second moving average of an engine speed of the second propulsion device, and an estimated watercraft speed based on an average of the first and second moving averages.

2. A watercraft as in claim 1, wherein the first and second ECUs adjust controlled operation of the first and second propulsion devices, respectively, so that a difference in engine speed between engines of the first and second propulsion devices is within a preset range.

3. A watercraft as in claim 1, wherein the operation information transmitted between the first and second ECUs comprises detected engine speed.

4. A watercraft as in claim 3, wherein the first and second ECUs adjust controlled operation of the first and second propulsion devices, respectively, so that a difference in engine speed between engines of the first and second propulsion devices is within a preset range.

5. A watercraft as in claim 4 additionally comprising a command device for sending a command signal to the propulsion devices, wherein the command device is electronically connected to one of the first and second ECUs, and the command signal is transmitted to the other of the first and second ECUs through the communication line.

6. A watercraft as in claim 5, wherein the command device comprises a switch to signal startup of the propulsion devices.

7. A watercraft as in claim 4 additionally comprising a user interface disposed at a cockpit of the watercraft, the user interface comprising a display and at least one operational switch, wherein the user interface is electronically connected to one of the first and second ECUs, and signals from the user interface are transmitted to the other of the first and second ECUs through the communication line.

8. A watercraft as in claim 4, wherein the preset range is about 100 rpm.

9. A watercraft as in claim 4 additionally comprising a third propulsion device supported by the hull and a third ECU adapted to send signals to control the third propulsion device and to receive operation information signals from the third propulsion device, wherein the communication line in combination with a second communication line electronically links the first, second and third ECUs so that operation information is transmitted between the first, second and third ECUs.

10. A watercraft as in claim 9 additionally comprising a second control device having a housing generally enclosing the third ECU.

11. A watercraft as in claim 1 additionally comprising a command device for sending a command signal to the propulsion devices, wherein the command device is electronically connected to one of the first and second ECUs, and the command signal is transmitted to the other of the first and second ECUs through the communication line.

12. A watercraft as in claim 11, wherein the command device comprises a single switch to signal startup of both the first and the second propulsion devices.

13. A watercraft as in claim 1 additionally comprising a user interface disposed at a cockpit of the watercraft, the user interface comprising a display and at least one operational switch, wherein the user interface is electronically connected to one of the first and second ECUs, and signals from the user interface are transmitted to the other of the first and second ECUs through the communication line.

14. A watercraft as in claim 1 additionally comprising a third propulsion device supported by the hull and a third ECU adapted to send signals to control the third propulsion device and to receive operation information signals from the third propulsion device, wherein the communication line in combination with a second communication line electronically links the first, second and third ECUs so that operation information is transmitted between the first, second and third ECUs.

15. A watercraft as in claim 14 additionally comprising a second control device having a housing generally enclosing the third ECU.

16. A watercraft as in claim 15, wherein the control device comprises a first shift/throttle lever adapted to generate a signal to control the first propulsion device and a second shift/throttle lever adapted to generate a signal to control the second propulsion device, wherein the third propulsion device is arranged on the hull between the first and second propulsion device, wherein the third ECU receives a signal from each of the first and second shift/throttle levers, and wherein the third ECU generates a signal to control the third propulsion device at a throttle setting between the throttle settings of the first and second shift/throttle devices.

17. A watercraft as in claim 15 additionally comprising a fourth propulsion device supported by the hull and a fourth ECU adapted to send signals to control the fourth propulsion device and to receive operation information signals from the fourth propulsion device, wherein the communication line electronically links the first, second, third and fourth ECUs so that operation information is transmitted between the first, second, third and fourth ECUs, and wherein the second control device generally encloses the fourth ECU.

18. A watercraft as in claim 1 additionally comprising means for controlling operation of the first and second propulsion devices, respectively, so that a difference in engine speed between engines of the first and second propulsion devices is within a preset range.

19. A watercraft as in claim 1, wherein each of the first and second ECUs performs a control routine that considers operation information received from the other one of the first and second ECUs in order to control the corresponding one of the first and second propulsion devices.

20. A watercraft as in claim 1, wherein only one of the first and second ECUs performs a control routine that considers operation information concerning the first and second propulsion units in order to control the first and second propulsion devices.

21. A watercraft as in claim 1, wherein the control device is further configured to vary a load on a steering handle device in accordance with the estimated watercraft speed.

* * * * *